US009644302B2

(12) United States Patent
Kim et al.

(10) Patent No.: US 9,644,302 B2
(45) Date of Patent: May 9, 2017

(54) WASHING MACHINE

(71) Applicant: Dongbu Daewoo Electronics Corporation, Seoul (KR)

(72) Inventors: In Dong Kim, Yongin-si (KR); Jeong Hyeon Kim, Anyang-si (KR); Hye Ung Kim, Seoul (KR); Ju Dong Lee, Incheon (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 23 days.

(21) Appl. No.: 14/157,030

(22) Filed: Jan. 16, 2014

(65) Prior Publication Data

US 2015/0167224 A1 Jun. 18, 2015

(30) Foreign Application Priority Data

Dec. 18, 2013 (KR) ..... 10-2013-0158052

(51) Int. Cl.

| | |
|---|---|
| ***D06F 23/00*** | (2006.01) |
| ***D06F 37/04*** | (2006.01) |
| ***D06F 23/02*** | (2006.01) |
| *D06F 37/30* | (2006.01) |
| *D06F 39/08* | (2006.01) |
| *D06F 23/06* | (2006.01) |

(52) U.S. Cl.

CPC ..... *D06F 37/04* (2013.01); *D06F 23/025* (2013.01); *D06F 23/065* (2013.01); *D06F 37/30* (2013.01); *D06F 37/302* (2013.01); *D06F 39/083* (2013.01); *D06F 39/088* (2013.01)

(58) Field of Classification Search

CPC ..... D06F 9/083; D06F 25/00; A47L 15/4204; A47L 15/4225; C06F 35/006

USPC .... 68/140, 23.7, 24, 23 R, 58, 207, 208, 19, 68/12.19, 13 R, 139; 134/111, 104.4, 134/198, 104.1, 186, 153, 172, 179; 8/159, 158, 137, 155.1

See application file for complete search history.

(56) References Cited

U.S. PATENT DOCUMENTS

| | | | | |
|---|---|---|---|---|
| 2,764,884 | A | 10/1956 | Constantine | |
| 4,941,333 | A | 7/1990 | Blessing | |
| 6,460,382 | B1 * | 10/2002 | Kim | D06F 37/304 68/140 |
| 6,776,087 | B1 * | 8/2004 | Amstad | A23N 7/02 99/540 |

(Continued)

FOREIGN PATENT DOCUMENTS

| | | | |
|---|---|---|---|
| BE | 626305 | A | 6/1963 |
| DE | 2301341 | A1 | 7/1973 |
| DE | 2427839 | A1 | 1/1976 |

(Continued)

*Primary Examiner* — David Cormier
*Assistant Examiner* — Thomas Bucci

(57) ABSTRACT

A washing machine that includes an integrated tub/drum that holds water, accommodates laundry, and rotates; a hollow rotary shaft coupled to and passing through one surface of the integrated tub/drum; a water supply pipe and a water drain pipe in the integrated tub/drum and through a passage or opening in the hollow rotary shaft; a nozzle that extends upward from an end of the water supply pipe that is in the integrated tub/drum; and a water drain that extends downward from an end of the water drain pipe that is in the integrated tub/drum.

5 Claims, 6 Drawing Sheets

(56) References Cited

U.S. PATENT DOCUMENTS

| | | | | |
|---|---|---|---|---|
| 2004/0083774 | A1* | 5/2004 | Kinouchi | D06F 37/225 68/23.1 |
| 2014/0033446 | A1* | 2/2014 | Vander Zwaag | D06F 37/28 8/137 |

FOREIGN PATENT DOCUMENTS

| | | | | | |
|---|---|---|---|---|---|
| EP | 0381423 | A1 | | 8/1990 | |
| FR | 1193840 | A | | 11/1959 | |
| FR | 2167350 | A1 | | 8/1973 | |
| GB | 1 422 395 | | * | 1/1973 | D06F 37/20 |
| GB | 1422395 | | | 1/1976 | |
| GB | 1509315 | A | | 5/1978 | |

* cited by examiner

WASHING MACHINE

CROSS-REFERENCE TO RELATED APPLICATIONS

This application is based on and claims priority from Korean Patent Application No. 10-2013-0158052, filed on Dec. 18, 2013, the disclosure of which is incorporated herein in its entirety by reference.

TECHNICAL FIELD

The present disclosure relates to a washing machine, and more particularly, to a washing machine having an integral or unitary tub and drum configured to hold washing water and accommodate and rotate laundry.

BACKGROUND

A washing machine is an apparatus that eliminates foreign matter or substances on or in laundry by agitating and/or rotating water, detergent, and the laundry together. Washing machines may be classified into a pulsator type washing machine that washes the laundry using a water flow generated by operation of a pulsator in a washing tub, and a drum type washing machine that rotates the drum to wash laundry by dropping the laundry vertically.

The drum type washing machine has a door that is at the front of the washing machine to place the laundry through the door. The rotating drum drops the laundry into the water and detergent to wash the laundry, and uses relatively small amounts of water and detergent. Specifically, a drum type washing machine in the related art includes a cabinet that forms an external appearance of the washing machine, a tub that is in the cabinet and that holds washing water, a rotatable drum that is in the tub and that accommodates or holds laundry, a drive motor that is installed on or near the tub and that provides power to rotate the drum, a water supply device that supplies water to the tub, and a water drain that discharges water from the tub to the outside of the cabinet (e.g., a drain pipe) after the washing operation(s) end.

Accordingly, according to the drum type washing machine in the related art, when the laundry is washed, the laundry is put into the tub in a lateral direction by opening a door at the front of the washing machine, water is supplied to the tub, and then the laundry is washed while a lifter in the drum lifts up and drops the laundry as the drum rotates by operation of the drive motor.

As such, the drum type washing machine in the related art includes the tub in addition to the drum. That is, the drum type washing machine in the related art has a structure that has the tub hold washing water and the drum in the tub rotate and wash the laundry.

However, because the tub is typically made of a plastic material, the tub may be easily contaminated by hard water, scale or other foreign substance(s) that enter the tub as the tub is used over a long period of time. There is a problem in that it is difficult to clean the tub because of the presence of the drum when the tub is contaminated. When the tub is contaminated, the tub becomes dirty, corroded, or a source of foreign substances and/or contaminants, and then the laundry becomes contaminated, which may cause irritation or skin problems or disease to the user.

This problem also occurs in pulsator type washing machines as well as drum type washing machines. Pulsator type washing machines also include a reservoir (tub) in the main body thereof.

SUMMARY

The present disclosure has been made in an effort to provide a washing machine which uses an integrated, one-piece and/or unitary tub and/or drum (an "an integrated tub/drum"), thereby suppressing the generation of mold, scale and other contaminants on the inner surface(s) thereof and allowing the integrated tub/drum to be easily cleaned.

The present disclosure has been made in an effort to provide a washing machine which may effectively supply water to the integrated tub/drum and drain water from the integrated tub/drum.

One or more exemplary embodiments of the present disclosure provide a washing machine including an integrated tub/drum that holds washing water, accommodates laundry, and rotates; a hollow rotary shaft that is coupled to and passes through one surface of the integrated tub/drum; a water supply pipe and a water drain pipe in the integrated tub/drum and through a passage or opening in the hollow rotary shaft; a nozzle that extends upward from an end of the water supply pipe that is in the integrated tub/drum; and a water drain that extends downward from an end of the water drain pipe that is in the integrated tub/drum.

The nozzle may include a plurality of water supply holes in a side and/or surface of the nozzle, in a direction facing a center of the integrated tub/drum.

The water drain may include one or more drain holes at a lower end of the drain.

The integrated tub/drum may have a truncated conical shape, and the hollow rotary shaft may be coupled to and/or pass through one surface (e.g. an end) of the integrated tub/drum that has a relatively large area.

The water drain or water drain pipe may have a length greater than a radius of the end of the integrated tub/drum that has a relatively small area, and may be spaced apart from an inner circumferential surface of the integrated tub/drum.

The washing machine may further include a drive shaft that is coupled to another surface of the integrated tub/drum (e.g., the end of the integrated tub/drum away from or opposite to the end to and/or through which the hollow rotary shaft is coupled and/or passes); and a drive motor that rotates the drive shaft.

According to exemplary embodiments of the present disclosure, the washing machine includes an integrated tub/drum, thereby suppressing or preventing the generation of mold, mildew, scale or other contaminants on the inner surface of the drum, and allowing the integrated tub/drum to be easily cleaned.

According to exemplary embodiments of the present disclosure, the washing machine may effectively supply water to the integrated tub/drum and drain water from the integrated tub/drum.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
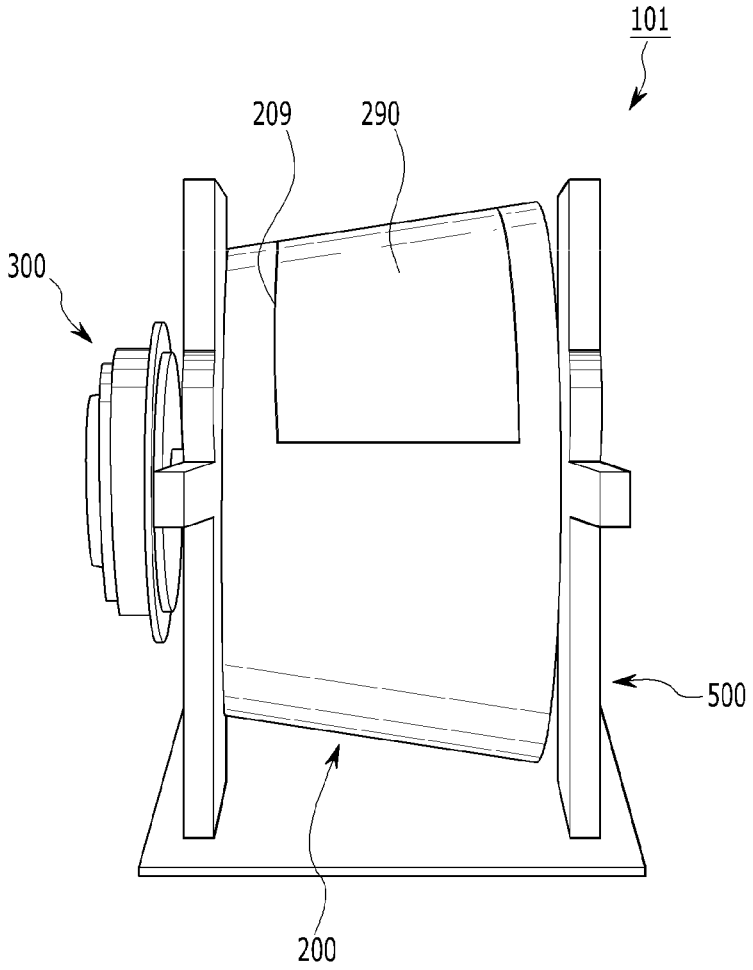
FIG. 1 is a perspective view of a washing machine according to one or more exemplary embodiments of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Hereinafter, one or more exemplary embodiments of the present disclosure will be described in detail with reference to the accompanying drawings so that those skilled in the technical field to which the present disclosure pertains may carry out the exemplary embodiments. The present disclosure may be implemented in various different forms, and is not limited to the exemplary embodiment(s) described herein.

The drawings are schematically illustrated, and the scales of the drawings are not necessarily identical to each other or necessarily to scale. Relative dimensions and ratios of the parts illustrated in the drawings may be exaggerated or reduced in size(s) thereof for clarification of the drawings and convenience, and any particular dimension is only illustrative, and is not limited thereto. The same structures, elements or components illustrated in two or more drawings are designated by the same reference numerals so as to illustrate the same or similar features.

The exemplary embodiments of the present disclosure are presented as ideal exemplary embodiments of the present disclosure. As a result, various modifications of the drawings are expected. Therefore, the exemplary embodiments are not limited to specific forms in regions illustrated in the drawings, and for example, includes modifications of forms by manufacturing.

Hereinafter, a washing machine 101 according to exemplary embodiments of the present disclosure will be described with reference to FIGS. 1 to 6.

Figure 2:
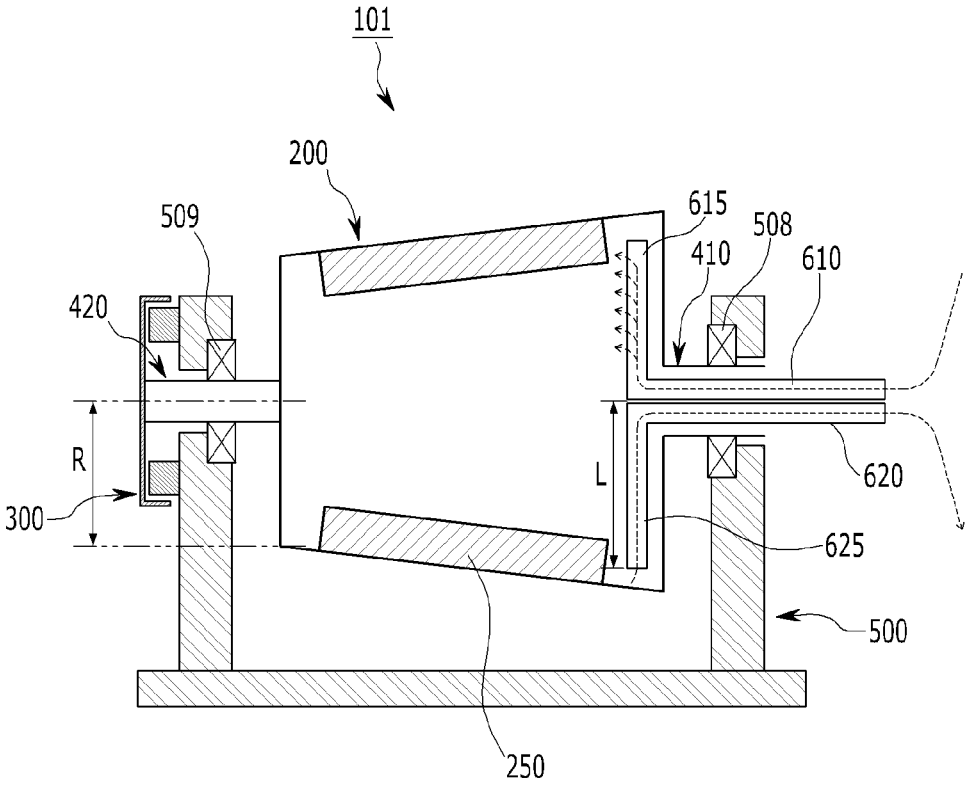
FIG. 2 is a cross-sectional view of the exemplary washing machine of FIG. 1.

As illustrated in FIGS. 1 and 2, the washing machine 101 according to exemplary embodiments of the present disclosure includes a integrated tub/drum 200, a hollow rotary shaft 410, a water supply pipe 610, a water drain pipe 620, a nozzle 615, and a water drain 625.

The washing machine 101 according to exemplary embodiments of the present disclosure may further include a lifter 250, a supporting bearing 508, a drive bearing 509, a drive shaft 420, and a drive motor 300.

Figure 6:
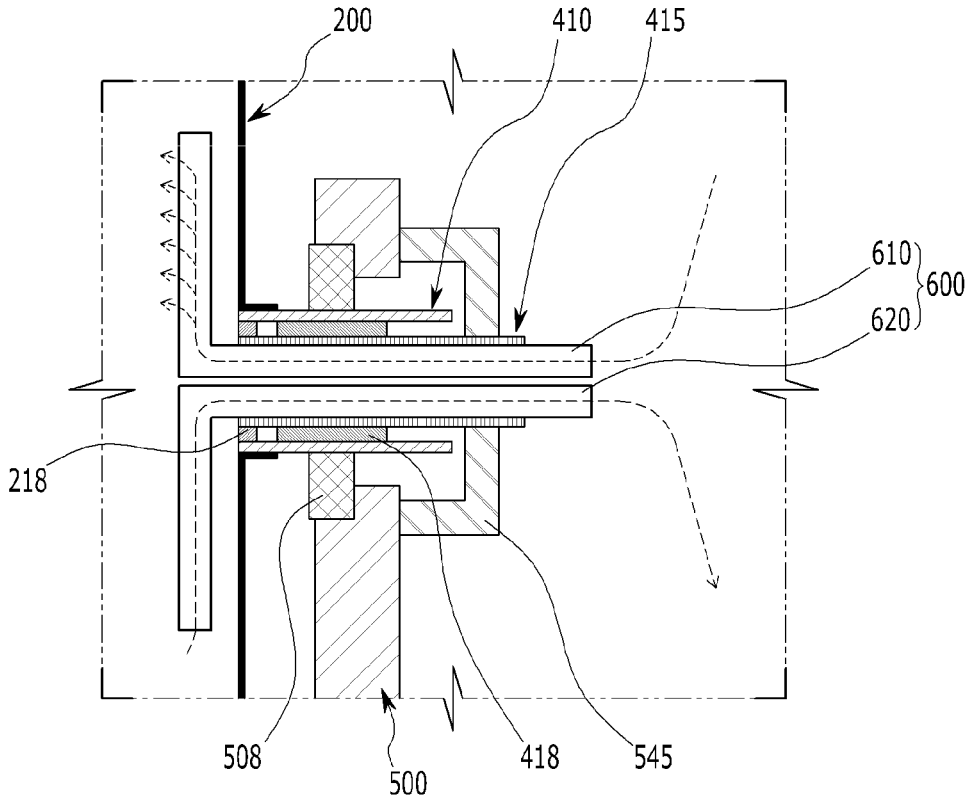
FIG. 6 is an enlarged cross-sectional view of a section of the exemplary hollow rotary shaft in FIG. 2.

As illustrated in FIG. 6, the washing machine 101 according to one or more exemplary embodiments of the present disclosure may further include a fixed shaft 415, a rotary bearing 418, a water seal 218, and a shaft fixing mechanism or brace 545.

Although not illustrated, the exemplary washing machine 101 may further include a cabinet or housing, a water supply pump, and/or a water drain pump.

The cabinet or housing forms an external shape and/or appearance of the washing machine 101, and a control panel for controlling the washing machine 101 may be installed in and/or on the cabinet. Because the cabinet may have various shapes that are known to those skilled in the art, a detailed description thereof will be omitted.

The water supply pump and the drain pump (which may be separate pumps, or only one pump providing both functions) supplies water to the tub 200 through a water supply pipe 610 or drains water from the tub 200 through a water drain pipe 620. Because the water supply pumps and drain pumps suitable for use in the washing machine 101 are also known to those skilled in the art, a detailed description thereof will be omitted.

The integrated tub/drum 200 simultaneously holds water, accommodates laundry, and rotates. The integrated tub/drum 200 may comprise or be made of stainless steel. Alternatively, the integrated tub/drum 200 may comprise or be made of metal and/or plastic, and have a ceramic and/or stain-resistant coating on the inner surface thereof. That is, according to various exemplary embodiments of the present disclosure, the integrated tub/drum 200 is not easily contaminated by water scale or other foreign substances, and may be easily cleaned even if the integrated tub/drum 200 is contaminated.

In exemplary embodiments of the present disclosure, the integrated tub/drum 200 has a truncated conical shape. However, exemplary embodiments of the present disclosure is not particularly limited thereto, and the integrated tub/drum 200 may have a cylindrical shape or "barrel" shape.

The integrated tub/drum 200 may include an opening 209 in the circumferential surface of the integrated tub/drum 200. The laundry may be put into the integrated tub/drum 200, or the laundry in the integrated tub/drum 200 may be taken out of the integrated tub/drum 200, through the opening 209.

The washing machine according to exemplary embodiments of the present disclosure may further include a drum cover 290 that is separably or removably coupled to the opening 209 of the integrated tub/drum 200. The drum cover 290 is removed from the integrated tub/drum 200 when the laundry is put into or taken out of the integrated tub/drum 200, and coupled to the integrated tub/drum 200 so as to tightly close the opening 209 when the laundry is washed. In one embodiment, the cover 290 slides into place in along snug and/or watertight grooves in the tub 200 at the opening 209. In another embodiment, the cover 290 is secured in place over the opening 209 by one or more clasps (and optionally, one or more mating tabs and recesses), and a gasket or seal may be along the periphery of the opening 209 and/or cover 290.

A plurality of lifters 250 may be inside the integrated tub/drum 200. The lifter 250 has a substantially rectangular, sloped rectangular, or bar shape that extends or protrudes from an inner circumferential surface of the integrated tub/drum 200 at a predetermined height toward a center of the integrated tub/drum 200.

Accordingly, when the integrated tub/drum 200 rotates, the laundry in the integrated tub/drum 200 is washed by being lifted up by the lifter 250 due to rotational force of the integrated tub/drum 200 and dropped back into the wash water and detergent.

The hollow rotary shaft 410 is coupled to and/or passes through one surface (e.g., a substantially circular end) of the integrated tub/drum 200. A passage or opening in the hollow rotary shaft 410 communicates with the interior of the integrated tub/drum 200.

The supporting frame 500 supports the hollow rotary shaft 410 so that the hollow rotary shaft 410 is rotatable. The supporting frame 500 may be accommodated in or coupled to the cabinet (not illustrated). The supporting frame 500 may have one or more shapes such as an intersecting 'X' shape, and the hollow rotary shaft 410 may be supported at the intersection. Alternatively, the frame 500 may have a V or inverted V shape (with the hollow rotary shaft 410 at the point of the V), or other shape or form that supports the tub 200 and rotary shaft 410.

However, exemplary embodiments of the present disclosure are not limited thereto, and the supporting frame 500 may have various shapes and/or comprise various structures that may be modified and carried out by those skilled in the art based on known technology.

Both the water supply pipe 610 and the water drain pipe 620 are inserted into the integrated tub/drum 200 through the passage or opening of the hollow rotary shaft 410. Alternatively, when the water supply pipe 610 and the water drain pipe 620 are integral with the nozzle 615 and drain 625, respectively, the water supply pipe 610 and the water drain pipe 620 are inserted into the rotary shaft 410 from an interior of the tub 200, or when the circular end panel of the tub 200 is integral or unitary with the rotary shaft 410, the water supply pipe 610 (integral with the nozzle 615) and the water drain pipe 620 (integral with the drain 625) may be inserted into the rotary shaft 410, and the end panel of the drum may be watertightly fixed, attached or secured to the tub/drum 200. The water supply pipe 610 supplies water to the interior of the integrated tub/drum 200, and the water drain pipe 620 discharges water from the interior of the integrated tub/drum 200.

Figure 3:
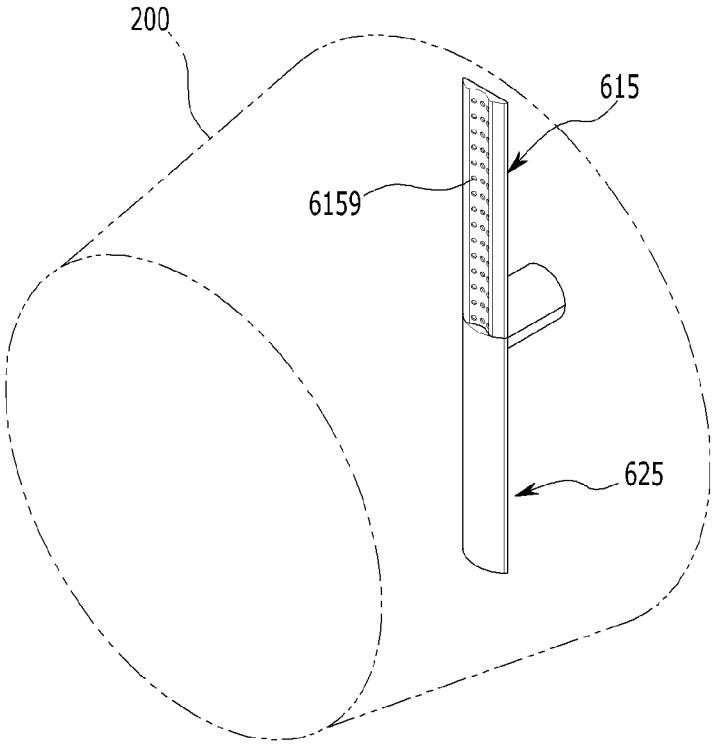
FIG. 3 is a perspective view illustrating an exemplary nozzle and an exemplary water drain in FIG. 2.
Figure 4:
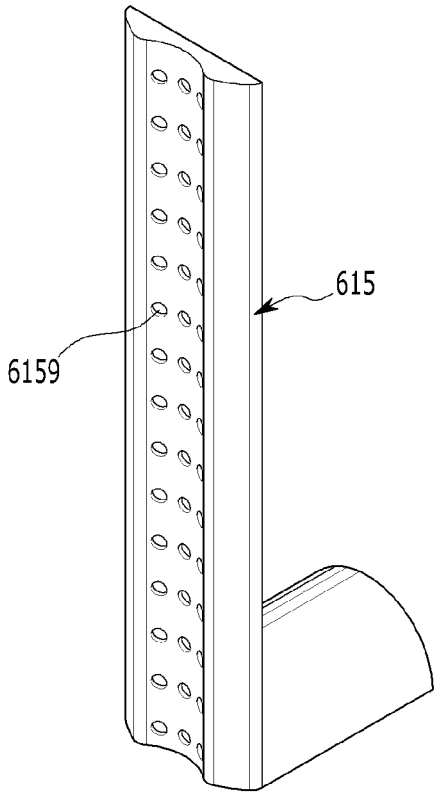
FIG. 4 is a perspective view that enlarges and illustrates the exemplary nozzle of FIG. 3.
Figure 5:
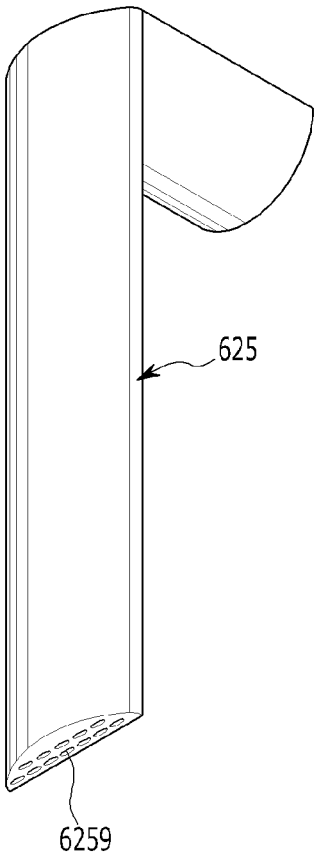
FIG. 5 is a bottom perspective view that enlarges and illustrates the exemplary water drain of FIG. 3.

In exemplary embodiments of the present disclosure, as illustrated in FIGS. 3 and 4, the nozzle 615 may extend and/or bend upward from an end of the water supply pipe 610 that is in the integrated tub/drum 200 through the hollow rotary shaft 410. Accordingly, the nozzle 615 may effectively supply water to the interior of the integrated tub/drum 200.

The nozzle 615 may include a plurality of water supply holes 6159 (FIGS. 3 and 4) that are formed in a side and/or surface of the nozzle 615 toward a center of the integrated tub/drum 200.

In exemplary embodiments of the present disclosure, the water drain 625 may extend and/or bend downward from an end of the water drain pipe 620 that is in the integrated tub/drum 200 through the hollow rotary shaft 410. Accordingly, the water drain 625 may effectively drain water from the integrated tub/drum 200.

When the integrated tub/drum 200 has a truncated conical shape, the hollow rotary shaft 410 may be coupled to and/or pass through an end panel or surface of the integrated tub/drum 200 that has a relatively large area, and the water drain 625 may be adjacent to the end panel or surface of the integrated tub/drum 200 that has the relatively large area. Accordingly, the water drain 625 may effectively collect the water in the integrated tub/drum 200, and drain the water through the water drain pipe 620.

The water drain 625 may have a length L that is greater than a radius R of the other end panel or surface of the integrated tub/drum 200 that has a relatively small area, and may be spaced apart from an inner circumferential surface of the integrated tub/drum 200 by a predetermined interval or distance (e.g., 5 cm or less, 2.5 cm or less, etc.).

Accordingly, the gradient of the integrated tub/drum 200 having a truncated conical shape may cause the water in the tub/drum 200 to be collected in an area near or at the relatively large end or surface of the integrated tub/drum 200, and the water drain 625 may effectively drain the collected water.

The water drain 625 may include one or more water drain holes 6259 (FIG. 5) that are formed at a lower end of the drain 625.

As illustrated in FIG. 6, a fixed shaft 415 is in the passage or opening of the hollow rotary shaft 410 and does not rotate. The fixed shaft 415 supports the water supply pipe 610 and the water drain pipe 620 therein. That is, even when the hollow rotary shaft 410 rotates, the water supply pipe 610 and the water drain pipe 620 in the fixed shaft 415 do not rotate.

One end of the fixed shaft 415 extends or protrudes outside of the hollow rotary shaft 410 (e.g., away from the tub/drum 200), and the shaft fixing mechanism or brace 545 connects the extending end of the fixed shaft 415 to the supporting frame 500. That is, the shaft fixing mechanism or brace 545 is coupled to the supporting frame 500 to support the fixed shaft 415 so that the fixed shaft 415 does not rotate in the hollow rotary shaft 410.

The rotary bearing 418 is between the hollow rotary shaft 410 and the fixed shaft 415 so that the hollow rotary shaft 410 and the fixed shaft 415 are slidable or rotatable relative to each other. That is, by the rotary bearing 418, the hollow rotary shaft 410 may rotate and the fixed shaft 415 is fixed. For example, the rotary bearing 418 may comprise a needle roller bearing.

The water seal 218 is between the hollow rotary shaft 410 and the fixed shaft 415 at an interface with the tub/drum 200, to block or prevent the water in the integrated tub/drum 200 from flowing into the rotary bearing 418 through the passage or opening of the hollow rotary shaft 410.

The supporting bearing 508 is between the hollow rotary shaft 410 and the supporting frame 500. That is, the supporting bearing 508 helps the supporting frame 500 to support the hollow rotary shaft 410 and enable the hollow rotary shaft 410 to rotate.

As illustrated in FIG. 2, the drive shaft 420 is coupled to the other end panel or surface (e.g., the relatively small end panel) of the integrated tub/drum 200, opposite to the end panel or surface to that the hollow rotary shaft 410 is coupled. That is, the integrated tub/drum 200 rotates while being supported by the drive shaft 420 and the hollow rotary shaft 410.

Like the hollow rotary shaft 410, the drive shaft 420 is also supported by the supporting frame 500. The drive shaft 420 may also be supported at the intersection of the supporting frame 500.

The drive bearing 509 is between the drive shaft 420 and the supporting frame 500. That is, the drive bearing 509 helps the supporting frame 500 to support the drive shaft 420 and enable the drive shaft 420 to rotate.

The drive motor 300 rotates the drive shaft 420, and provides rotational power to the integrated tub/drum 200.

In exemplary embodiments of the present disclosure, a controller (not shown) may control the drive motor 300 to start and/or stop the integrated tub/drum 200 so that the opening 209 of the integrated tub/drum 200 is positioned at or near the top or uppermost rotary position when the laundry is put into or taken out of the integrated tub/drum 200. That is, the drive motor 300 may move the opening 209 of the integrated tub/drum 200 to a position where the user can conveniently place the laundry into the integrated tub/drum 200 or take the laundry out of the integrated tub/drum 200.

According to the aforementioned configuration, the washing machine 101 according to exemplary embodiments of the present disclosure includes an integrated tub/drum 200, thereby suppressing formation and/or generation of scale, mold, mildew, and/or other contaminants on an inner surface of the tub, and allowing the integrated tub/drum 200 to be easily cleaned.

According to exemplary embodiments of the present disclosure, the washing machine 101 includes a nozzle (e.g., 615) and a drain (e.g., 625), thereby effectively supplying the water to the integrated tub/drum 200 and draining or removing the water from the integrated tub/drum 200.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A washing machine comprising:

an integrated tub/drum configured to hold water, accommodate laundry, and rotate;

a hollow rotary shaft coupled to and passing through pass through a surface of the integrated tub/drum;

a water supply pipe and a water drain pipe in the integrated tub/drum and through a passage or opening in the hollow rotary shaft;

a nozzle extending from an end of the water supply pipe in the integrated tub/drum;

a water drain that extends from an end of the water drain pipe in the integrated tub/drum;

a drive shaft coupled to an end surface of the integrated tub/drum other than the surface through which the hollow rotary shaft passes; and a drive motor configured to rotate the drive shaft, wherein the integrated tub/drum has a truncated conical shape, and the hollow rotary shaft is coupled to pass through an end surface of the integrated tub/drum having a relatively wide area, wherein the water drain extends downward from the water drain pipe, and is curved or bent towards a center of the integrated tub/drum, wherein the water drain has a length greater than a radius of an end of the integrated tub/drum having a relatively small area, and is spaced apart or separate from an inner circumferential surface of the integrated tub/drum;

wherein the motor and the drive shaft are connected in series, wherein the nozzle extends upward from the water supply pipe, and is curved or bent towards a center of the integrated tub/drum, and wherein the nozzle includes a plurality of water supply holes in a side and/or surface of the nozzle facing toward the center of the integrated tub/drum.

2. The washing machine of claim 1, wherein the water supply pipe and the water drain pipe are substantially fixed in place, and do not rotate.

3. The washing machine of claim 1, wherein the water drain includes one or more water drain holes at an end thereof.

4. The washing machine of claim 1, wherein the washing machine is a front-loading washing machine.

5. The washing machine of claim 1, further comprising a controller that controls the drive motor to stop the integrated tub/drum so that an opening of the integrated tub/drum is positioned at or near the top or uppermost rotary position of the integrated tub/drum.

* * * * *